US009670561B2

(12) United States Patent
Li et al.

(10) Patent No.: US 9,670,561 B2
(45) Date of Patent: Jun. 6, 2017

(54) APPARATUS AND A METHOD FOR SURFACE PROCESSING A METALLIC STRUCTURE

(71) Applicant: City University of Hong Kong, Kowloon (HK)

(72) Inventors: Ying Li, Kowloon (HK); Jian Lu, Kowloon (HK)

(73) Assignee: City University of Hong Kong, Hong Kong (HK)

( * ) Notice: Subject to any disclaimer, the term of this patent is extended or adjusted under 35 U.S.C. 154(b) by 474 days.

(21) Appl. No.: 14/250,740

(22) Filed: Apr. 11, 2014

(65) Prior Publication Data

US 2015/0290696 A1 Oct. 15, 2015

(51) Int. Cl.

| | |
|---|---|
| ***C21D 7/06*** | (2006.01) |
| ***C21D 7/00*** | (2006.01) |
| ***C21D 9/08*** | (2006.01) |
| *C21D 7/04* | (2006.01) |

(52) U.S. Cl.

CPC ..... *C21D 7/00* (2013.01); *C21D 7/06* (2013.01); *C21D 9/08* (2013.01); *C21D 7/04* (2013.01); *C21D 2221/10* (2013.01)

(58) Field of Classification Search

CPC .... C21D 7/06; C21D 7/00; C21D 9/08; B24C 1/10; B24C 1/083; B24C 5/005; B24B 1/04

USPC ..... 72/53

See application file for complete search history.

(56) References Cited

U.S. PATENT DOCUMENTS

| | | | | |
|---|---|---|---|---|
| 5,509,286 | A * | 4/1996 | Coulon | B24C 1/10 451/76 |
| 6,505,489 | B2 * | 1/2003 | Berthelet | B24B 1/04 219/121.6 |
| 7,647,800 | B2 * | 1/2010 | Cheppe | B24C 5/005 29/90.7 |
| 7,673,486 | B2 * | 3/2010 | Bayer | B24C 1/10 29/90.7 |
| 8,650,920 | B2 * | 2/2014 | Bayer | B24C 1/083 29/90.7 |
| 2009/0301152 | A1 * | 12/2009 | Bayer | B24C 1/10 72/53 |
| 2010/0294010 | A1 * | 11/2010 | Fujita | B24B 1/04 72/53 |
| 2011/0179843 | A1 * | 7/2011 | Ventzke | C21D 7/06 72/53 |
| 2011/0308290 | A1 * | 12/2011 | Bunting | B23P 6/002 72/53 |

* cited by examiner

*Primary Examiner* — David B Jones

(74) *Attorney, Agent, or Firm* — Renner Kenner Greive Bobak Taylor & Weber

(57) ABSTRACT

The present invention relates to an apparatus and a method for processing a surface. The apparatus comprising a platform arranged to support a structure having an inner surface; at least one ball disposed adjacent to the inner surface; and a reflecting member having at least one reflecting surface; wherein the at least one ball is adapted to vibrate by a vibrating means and to collide with the inner surface and the reflecting surface thereby creating an impact to the inner surface.

29 Claims, 7 Drawing Sheets

APPARATUS AND A METHOD FOR SURFACE PROCESSING A METALLIC STRUCTURE

FIELD OF THE INVENTION

The invention relates to an apparatus and a method for surface processing a metallic structure. Particularly but not exclusively, the invention relates to an apparatus and a method for surface processing a tubular metallic structure.

BACKGROUND OF THE INVENTION

Tubular metallic structures are widely used in various industries including manufacturing and constructions for carrying loads or providing supports. Efforts have been made to improve the strength of these tubular metallic structures to enhance safety and stability. The improvement in the strength of the tubular metal structures also assists in replacing bulky and heavy metallic tubes with smaller and lighter tubes, and thus reducing the overall size and weight of the resulting products or structures.

Surface treating or processing is a convenient method for improving strength a structure, and particularly, a metallic structure. In 1999, the process of Surface Mechanical Attrition Treatment (SMAT) is first proposed by K. Lu and J. Lu, and since then the process has attracted increasing interests in the field. SMAT is an efficient method to create a layer of nano-crystallized structure on the surface of metals. Balls having a smooth, spherical surface generally made of stainless steel, tungsten-carbide and ceramics, etc., are placed in a working chamber along with a metallic sample to be surface-treated. The balls are then made to vibrate to resonance by a vibration generator, and that the sample is then subjected to collision by a large number of fast moving balls over a short period of time. Each collision creates an impact which induces plastic deformation with a high strain rate to the metal surface of the sample. As a consequence, the repeated multi-directional impacts at high strain rate onto the sample surface result in numerous plastic deformations and grain refinements, which progressively down to the nanometer regime over the entire sample surface and provides a significant enhancement on the strength of the surface being treated.

SMAT has been proved successful in enhancing strength of a planar surface or an outer surface of a tubular structure. However, treatment on an inner surface of a tubular structure remains a critical problem which significantly affects the efficacy of the treatment and thus the strength of the resulting structure. Accordingly, there has been a continual need for an effective and simple method in processing an inner surface of a tubular structure.

SUMMARY OF THE INVENTION

In accordance with a first aspect of the present invention, there is provided a method for processing a surface, comprising the steps of supporting a structure having an inner surface on a platform, disposing at least one ball adjacent to the inner surface, positioning a reflecting member adjacent to the inner surface, wherein the at least one ball is adapted to vibrate by a vibrating means and to collide with the inner surface and the reflecting member thereby creating an impact to the inner surface.

In an embodiment of the first aspect, at least part of the reflecting member is arranged within the structure.

In an embodiment of the first aspect, the vibrating means is positioned below the platform.

In an embodiment of the first aspect, the vibrating means is positioned at least partially within the structure.

In an embodiment of the first aspect, the structure is positioned such that a central axis thereof is substantially perpendicular to the platform.

In an embodiment of the first aspect, the central axis of the structure is arranged in parallel to a longitudinal axis of the reflecting member.

In an embodiment of the first aspect, the structure and the reflecting member are coaxially arranged.

In an embodiment of the first aspect, the structure, the reflecting member and the vibrating means are coaxially arranged.

In an embodiment of the first aspect, the structure is of tubular shape.

In an embodiment of the first aspect, the reflecting member comprises a circular side wall circumferentially abuts the inner surface of the structure.

In an embodiment of the first aspect, the reflecting member comprises at least one inclined wall extended downwardly and tapered inwardly from the circular side wall, the at least one inclined wall is adapted to collide with the ball.

In an embodiment of the first aspect, at least part of the reflecting member is of a shape of a frustum.

In an embodiment of the first aspect, the structure is made of metal or metal alloy.

In accordance with a second aspect of the present invention, there is provided an apparatus for processing a surface, comprising a platform arranged to support a structure having an inner surface, at least one ball disposed adjacent to the inner surface, and a reflecting member having at least one reflecting surface, wherein the at least one ball is adapted to vibrate by a vibrating means and to collide with the inner surface and the reflecting surface thereby creating an impact to the inner surface.

In an embodiment of the second aspect, at least part of the reflecting member is arranged within the structure.

In an embodiment of the second aspect, the vibrating means comprises a vibrating horn.

In an embodiment of the second aspect, the vibrating means is positioned below the platform surface.

In an embodiment of the second aspect, the vibrating means is positioned at least partially within the structure.

In an embodiment of the second aspect, the structure is positioned such that a central axis thereof is substantially perpendicular to the platform.

In an embodiment of the second aspect, the central axis of the structure is arranged in parallel to a longitudinal axis of the reflecting member.

In an embodiment of the second aspect, the structure and the reflecting member are coaxially arranged.

In an embodiment of the second aspect, the structure, the reflecting member and the vibrating means are coaxially arranged.

In an embodiment of the second aspect, the structure is of tubular shape.

In an embodiment of the second aspect, the reflecting member comprises a circular side wall circumferentially abuts the inner surface of the structure.

In an embodiment of the second aspect, the reflecting member comprises at least one inclined wall extended downwardly and tapered inwardly from the circular side wall, the at least one inclined wall is adapted to collide with the at least one ball.

In an embodiment of the second aspect, the reflecting member comprises a base portion extended downwardly from the at least one inclined wall and is positioned adjacent to the platform.

In an embodiment of the second aspect, at least part of the reflecting member is of a shape of a frustum.

In an embodiment of the second aspect, the tubular structure is made of metal or metal alloy In an embodiment of the second aspect, the platform is supported by a supporting arrangement.

In an embodiment of the second aspect, the structure is fixedly positioned on the platform via a fixing means.

Further aspects of the invention will become apparent from the following description of the drawings, which are given by way of example only to illustrate the invention.

DETAILED DESCRIPTION OF THE PREFERRED EMBODIMENTS

The present invention relates to an apparatus for processing a surface. The apparatus comprising a platform arranged to support a structure having an inner surface; vibrating means at least one ball disposed adjacent to the inner surface; and a reflecting member having at least one reflecting surface; wherein the at least one ball is adapted to vibrate by a vibrating means and to collide with the inner surface and the reflecting surface thereby creating an impact to the inner surface.

The present invention also relates to a method for processing a surface. The method comprising the steps of supporting a structure having an inner surface on a platform vibrating means; disposing at least one ball adjacent to the inner surface; positioning a reflecting member adjacent to the inner surface; wherein the at least one ball is adapted to vibrate by a vibrating means and to collide with the inner surface and the reflecting member thereby creating an impact to the inner surface.

Specifically, the present invention involves the use of the Surface Mechanical Attrition Treatment (SMAT) for processing a surface of a metallic structure, particularly but not exclusively, an inner surface of a metallic tubular structure. In addition, the term "metallic" may include metals, metal alloys or a mixture thereof. Nevertheless, a person skilled in the art would appreciate that the apparatus and the method of the present invention are also applicable in processing inner surfaces of structures having different shapes or geometric configurations, or structures being made of other materials, as long as the skilled person may consider appropriate in doing so.

Figure 1:
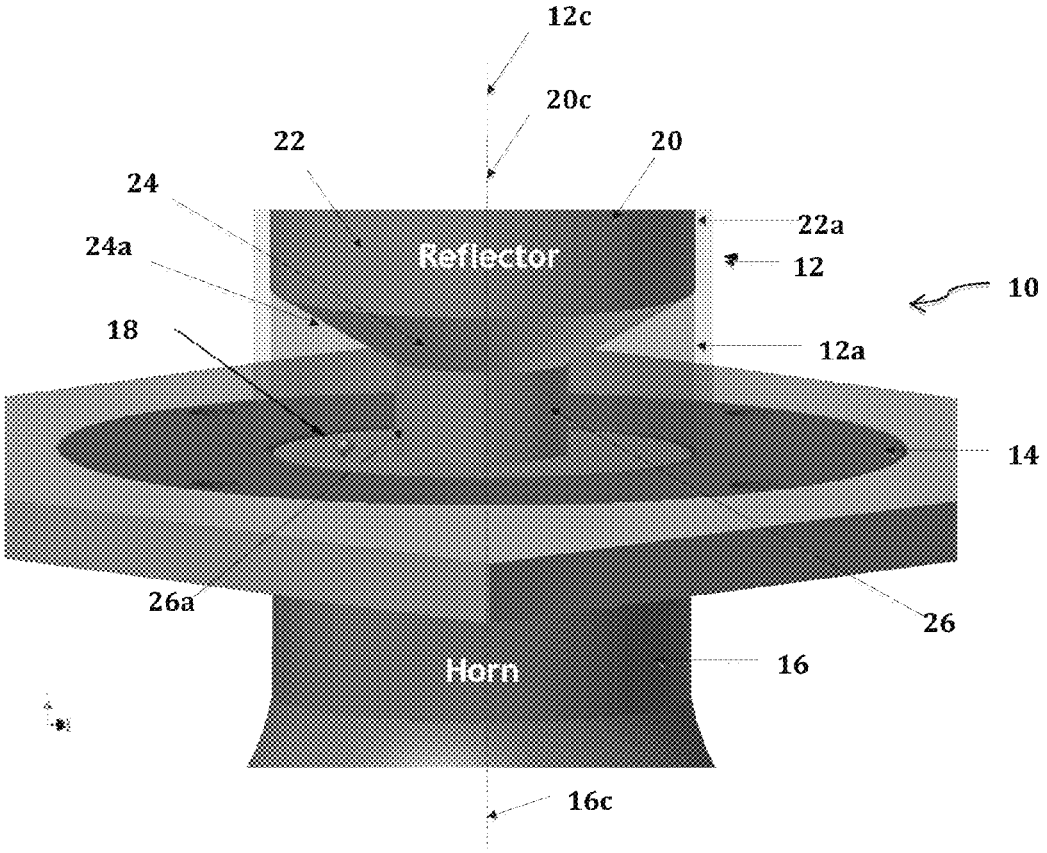
FIG. 1 shows a schematic diagram of an embodied arrangement of the apparatus for surface processing according to the present invention.

FIG. 1 shows an embodiment of the surface processing apparatus 10 of the present invention. As shown in FIG. 1, a tubular structure 12 having an inner surface 12*a* to be treated by the SMAT process is placed on a platform 14. The tubular structure 12 is positioned such that its central axis 12*c* is substantially perpendicular to the surface of the platform 14. A vibration horn 16, such as an ultrasonic vibration horn, which is capable of producing vibrations to a number of balls 18, is placed below the platform 14 such that when in operation, the vibration horn will vibrate such that the number of balls 18 will also vibrate. Preferably, the horn 16 is a part of an ultrasonic system which is arranged to vibrate so as to output ultrasonic vibrations to the number of balls 18. The vibration horn 16 is also preferably in near proximity to the platform 14, but does not contact with the platform 14 such that the platform does not damper the vibration from the horn 16. Alternatively, the vibrating horn 16 may also be arranged inside or partially inside the tubular structure 12 so as to provide the required vibrations to the balls 18.

The balls 18 are made of rigid materials such as stainless steel, tungsten carbide or ceramic etc. are introduced into the hollow center of the tubular structure 12. The balls 18 can be of a diameter of about 1 mm to about 3 mm, and will be set in motion inside the tubular structure 12 when the vibrating horn 16 is actuated to produce vibration to the balls 18. The number of balls 18 being used is mainly dependent on the geometric dimension of the apparatus including the tubular structure, the reflector and also the dimension of the ball itself.

A reflector 20 is positioned inside or partially inside the tubular structure 12. In this particular embodiment as shown in FIG. 1, the reflector 20 comprises a cylindrical upper portion 22 having a circular side wall 22*a* which snugly abuts the inner surface 12*a* of the tubular structure 12. The cylindrical upper portion 22 extends downwardly and tapers inwardly to form a frustum-shaped middle portion 24, which includes an inclined, annular side wall 24*a*. The middle portion 24 further extends downwardly to form a cylindrical base portion 26 which is positioned adjacent to the surface of platform 14. The base portion 26 includes a cylindrical side wall 26*a*. In this example embodiment, the reflector 20 is does not engage or touch the vibrating horn 16, but rather, it is placed in close proximity to the vibrating horn 16 such that the vibration horn 16 is able to transmit vibration energy to the balls 18 disposed between the spaces defined by the tubular structure 12, reflector 20 and the horn 16. Preferably, the distance between the reflector 20 and the horn 16 can be controlled and set such that optimal oscillation or vibration energy is transmitted to the balls 18 whilst minimizing the vibration of unnecessary components such as the reflector so as to reduce any dampening of the vibrations.

This circular side wall 22*a* seals the hollow center of the tubular structure 12 from the external and thus encases the balls 18 within a tube cavity defined by the inner surface 12*a* of the tubular structure 12, the inclined side wall 24*a* of the middle portion 24, the cylindrical side wall 26*a* of the base portion 26, and the surface of the platform 14. Upon actuation of the vibrating horn 16, the balls 18 which are encased within the tube cavity will be set to vibration in a random motion. At a specific vibration frequency movement of the balls 18 will come to resonance, and will collide continuously with the inner surface 12*a* of the tubular structure 12. The collisions will also be reflected at the surfaces of the inclined side wall 24*a* and the cylindrical side wall 26*a*, which enhance the colliding effects to provide more vigorous impacts at the inner surface 12*a*. Each impact by the balls 18 induces plastic deformation with a high strain rate at the spot of collision of the inner surface 12*a*. Consequentially, the repeated multidirectional collisions result in significant mechanical impacts in the form of plastic deformations and grain refinements on the inner surface 12*a* of the tubular structure 12, and the impacts will progress down into the submicron regime over the inner surface 12*a* to create nano-crystallized structures at the inner surface 12*a* which improve the strength of the tubular structure 12.

Specifically, the central axis 12*c* of the tubular structure 12 coincides with the longitudinal axis 20*c* of the reflector 20, or both the longitudinal axes of the reflector 20 and the vibration horn 16 so as to provide maximized impacts to the tubular structure 12. Alternatively, the central axis 12*c* can be arranged in parallel to the longitudinal axis 20*c* of the reflector 20, or in parallel to both the longitudinal axes of the reflector 20 and the vibration horn 16 so as to provide impacts to the tubular structure 12.

Figure 2:
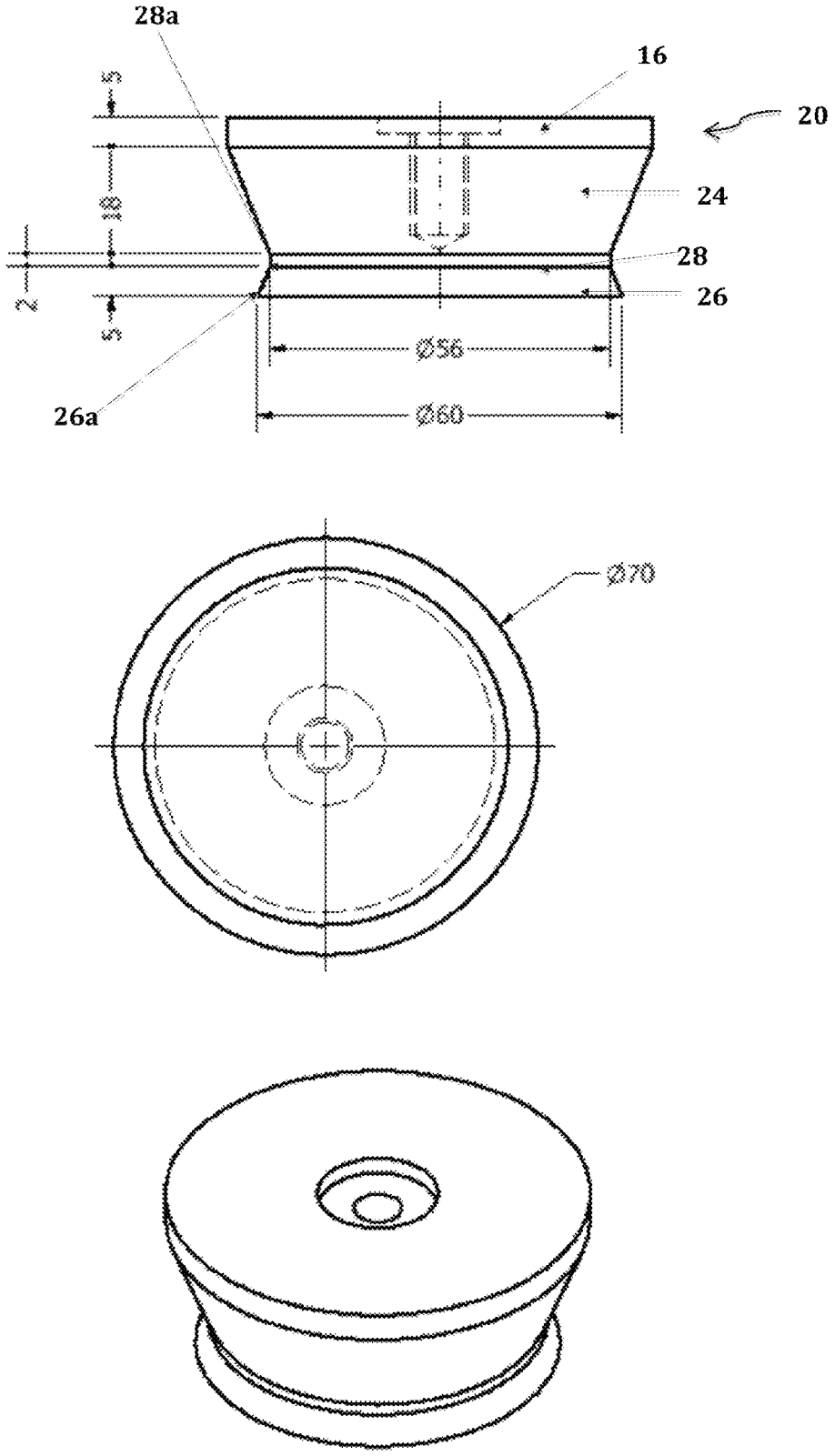
FIG. 2 shows a schematic diagram of an embodied reflector of the present invention.

FIG. 2 shows another preferred embodiment of surface processing apparatus with an alternative design of the reflector 20. In this embodiment, the reflector 20 includes an additional neck portion 28 in between the frustum-shaped middle portion 24 and the base portion 26. In addition, the base portion 26 is of a frustum shape instead of a cylindrical shape, having a narrower top surface connecting with the neck portion 28, and a wider base surface adapted to engage with the platform 14. As shown in FIG. 2, the cylindrical upper portion 22 having a diameter of about 70 mm and a height of about 5 mm; the middle portion 24 having a height of about 18 mm; the neck portion 28 having a height of about 2 mm; and the base portion 26 having a top surface diameter of about 56 mm, a base surface diameter of about 60 mm, and a height of about 5 mm. The side wall 28*a* and the inclined side wall 26*a* also serve as reflecting surfaces for the balls 18 so as to enhance the impacts on the inner surface 12*a* of the tubular structure 12. With this particular design of the apparatus, the number of balls being used is approximately 70.

Figure 3:
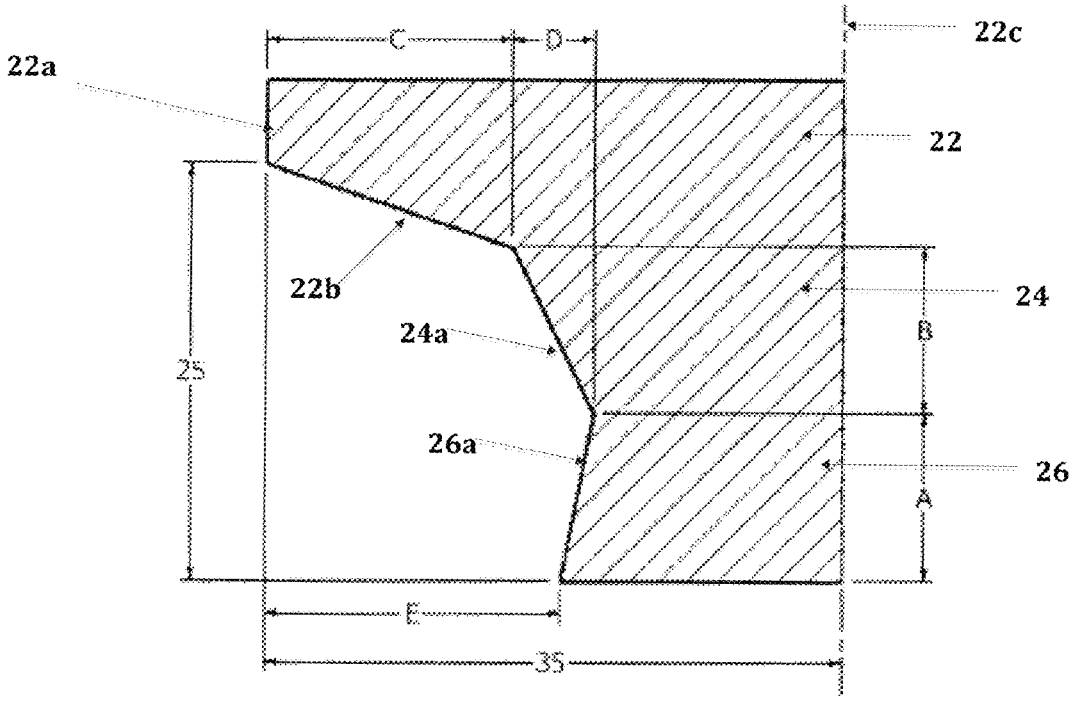
FIG. 3 shows a schematic cross-sectional diagram of another embodiment of the reflector of the present invention.

FIG. 3 shows a cross-sectional view of a third embodiment on the design of the reflector 20. In this embodiment, the upper portion 22 includes a cylindrical side wall 22*a* and an inwardly inclined, annual side wall 22*b* which also serves as a reflecting surface for the balls 18 in addition to the inclined side wall 24*a* of the middle portion 24 and the inclined side wall 26*a* of the base portion 26. Referring to FIG. 3, the upper portion 22 having a diameter of about 70 mm; the height of the tube cavity is about 25 mm; A is of a range of about 0-20 mm; B is of a range of about 0-20 mm; C is of a range of about 0-30 mm; D is of a range of about 5-15 mm; and E is of a range of about 3-35 mm. Preferably, A is of about 5 mm; B is of about 2 mm; C is of about 5 mm; D is of about 2 mm; and E is of about 5 mm.

Figure 4:
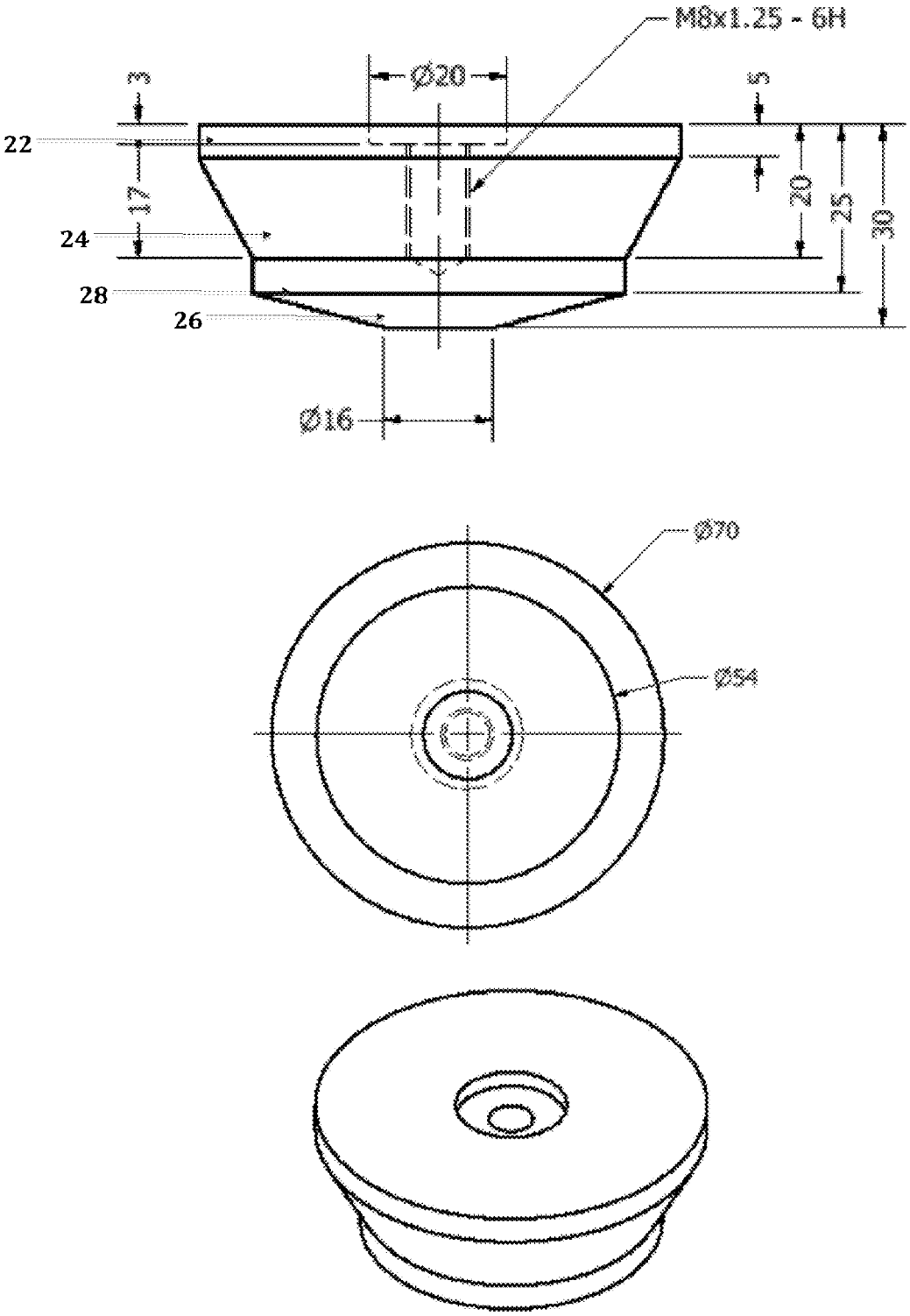
FIG. 4 shows a schematic diagram of a further embodiment of the reflector of the present invention.

FIG. 4 shows another embodiment on the design of the reflector 20. Being similar to the structures of the previously discussed embodiments, this reflector 20 includes a cylindrical upper portion 22, a middle portion 24, a neck portion 28 and a base portion 26. As shown in the figure, the cylindrical upper portion 22 having a diameter of about 70 mm and a height of about 3 mm; the middle portion 24 having a height of about 17 mm; the neck portion 28 having a height of about 5 mm; and the base portion 26 having a height of about 5 mm.

Although a number of preferred designs of the reflector 20 have been described, a person skilled in the art will appreciate that the design of the reflector of the present invention should not be limited to the specific embodiments. Instead, the skilled person will understand that variations to the design will be applicable to the present invention as long as the reflector provides a reflecting surface to reflect the balls onto the inner surface to be treated of the tubular structure.

In an embodiment of treating a tubular structure with the apparatus of the present invention, a tubular structure 12 with an inner diameter of about 70 mm with a wall thickness of about 3 mm has been used. The tubular structure 12 is subjected to impact by the balls 18 for about 15 min under a vibration frequency of about 20 KHz. Each of the balls 18 is of a diameter of about 3 mm. Again, variation to the configurations of the tubular structure and the ball, and treatment conditions is applicable to the present invention as long as it is considered appropriate to the skilled person in the art.

Figure 5:
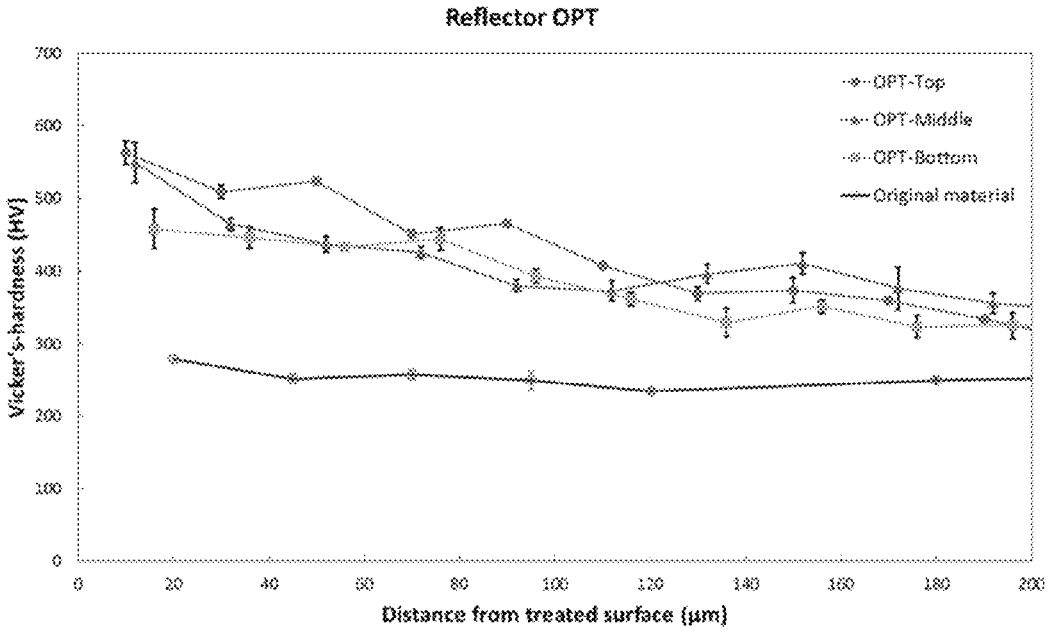
FIG. 5 shows the micro-hardness distribution of a tube sample after surface processed by an apparatus according to the present invention having a reflector design as shown in FIG. 2.

The improvement of strength of the tubular structure as treated by the apparatus of the present invention having a reflector as shown in FIG. 2 is demonstrated in FIG. 5, which shows the micro-hardness distribution on the cross-section of the wall of a sample tube after the SMAT according to the present invention at the inner surface of the tube sample when compared with an untreated tube. The SMAT was conducted by using balls of a diameter of about 3 mm and vibration frequency of about 20 kHz for about 30 min. The sample tube is of an inner diameter of about 71 mm, a thickness of about 3 mm, and a height of about 25 mm.

The micro-hardness test is performed by using the Vickers hardness test method which consists of indenting the test material with a diamond indenter in the form of a right pyramid having a square base and an angle of 136 degree between the opposite faces, and the indenter is subjected to a load of 1 to 100 kgf. The full load is normally applied for 10 to 15 seconds. The two diagonals of the indentation left in the surface of the material after removal of the load are measured using a microscope and their average is calculated. The area of the sloping surface of the indentation is also calculated. The Vickers hardness is the quotient obtained by dividing the kgf load by the square mm area of indentation.

In this experiment, the sample tube was mounted in cross section in a conductive epoxy to conduct the hardness measurements. Surface of the sample being tested was first polished using successively fine grit size abrasives media prior to the measurements to eliminate surface damage. The measurements took place at different locations of the treated surface along the height of the sample, from top to bottom, and a testing force of 100 mN was applied for a duration of 10 s. Hardness of the cross-section of the SMAT treated sample surface was measured with an interval of 20 μm in the first 200 μm range. At least three measurements were taken at each distance and the average of these measurements was shown in each data point of FIG. 5. The original, untreated material was also measured under the same condition.

As shown in FIG. 5, it can be seen that the micro-hardness of a treated sample tube increased greatly near the treated surface and decreased along the depth from the treated surface. At the treated surface, the highest hardness could be almost twice of the hardness of the original, untreated material. When comparing with the original, untreated material, even at the distance of 200 μm from the treated surface, the treated material still demonstrated an improved hardness. At different locations such as top, middle and bottom of the tube sample, the hardness data as measured were similar. This means that the treatment effect was generally even along the height of the sample tube being tested. The results clearly revealed that the method and apparatus of the present invention is capable of improving the hardness of the treated material, and the improvement is even along the treated surface of the tube.

Figure 6:
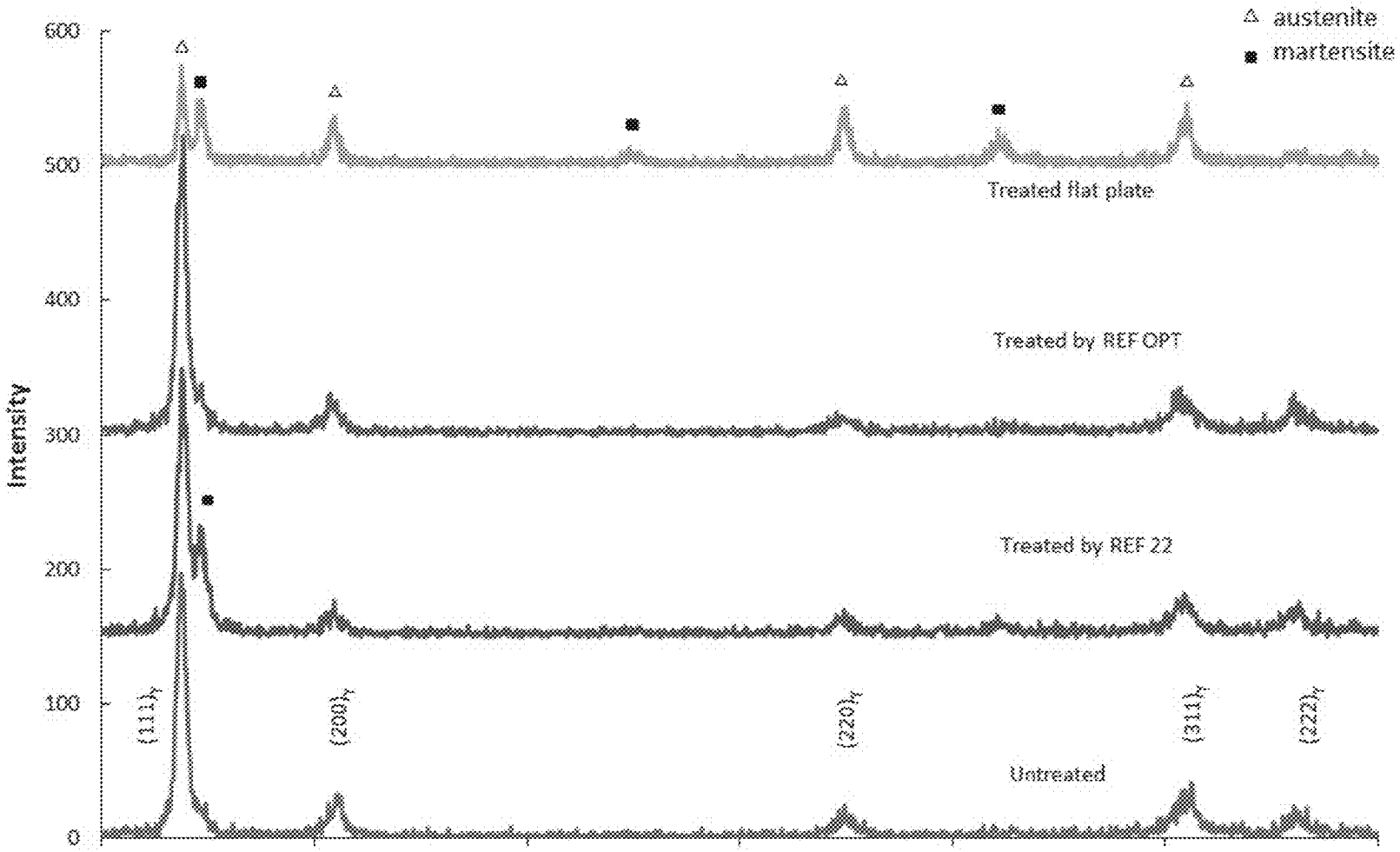
FIG. 6 shows the x-ray diffraction (XRD) results of a surface treated planar sample and tube samples after surface treated by apparatuses according to the present invention having reflector designs as shown in FIGS. 2 and 4.

The crystalline structure of the SMAT treated surface of a tube sample is further measured by X-ray diffraction (XRD) analysis with the results being demonstrated in FIG. 6. XRD analysis is a rapid analytical technique primarily used for phase identification of a crystalline material and can provide information on unit cell dimensions. The measurement is a nondestructive, and can be used to determine material structural properties, such as grain size and phase composition. In this experiment, it was introduced to examine the treated samples on whether there has been any phase transformation during the SMAT of the present invention.

In general, XRD measures the intensity of an X-ray beam reflected from a small area. The atomic-level spacing within the crystal lattice of the specimen can then be determined based on the intensity results. XRD reveals different phases with identical compositions with finer details of the crystal structure such as the state of atomic "order" which accounts for their different properties. In addition, strain analysis and determination of the degree of crystallization can also be assessed.

The XRD analysis was carried out on the treated surface of a sample tube having an inner diameter of about 71 mm, a thickness of about 3 mm, and a height of about 25 mm. The SMAT was conducted by using the apparatus of the present invention having a reflector as shown in FIG. 2, with balls of a diameter of about 3 mm and vibration frequency of about 20 kHz for about 30 min.

To conduct the XRD analysis, the sample tube was first glued onto a silica base and the XRD patterns were measured using a ($\theta$–2 $\theta$) Philips diffractometer with Cu K$\alpha$ radiation. The acquisition conditions were $\Delta$ (2 $\theta$)=0.04°, $\Delta$t/step (2 $\theta$)=1 s.

The XRD results of an untreated sample tube, a sample tube treated by a reflector as shown in FIG. 4, a sample tube treated by another reflector as shown in FIG. 2, and a planar sample plate (flat plate) treated by a conventional SMAT device without a reflector, are shown in FIG. 6. It is interesting to note that only the sample treated by the reflector of FIG. 2 shows no obvious martensite phase transformation after the SMAT treatment. For the sample treated by the reflector as shown in FIG. 4 and also the planar sample plate, patterns showing the martensite phase transformation are observed. Similarly phenomenon of martensite phase transformation have already been noticed in the other planar samples treated in other SMAT tests. This finding is important as the observed martensite phase is not desirable in some situations as it may reduce the corrosion resistance of stainless steel, and the results demonstrated that the reflector design as shown in FIG. 2 is preferred over some other designs such as that as shown in FIG. 4 at least in the context of martensite phase transformation, although all reflector designs as described in this application have shown beneficial effects in the improvement of material hardness.

Figure 7:
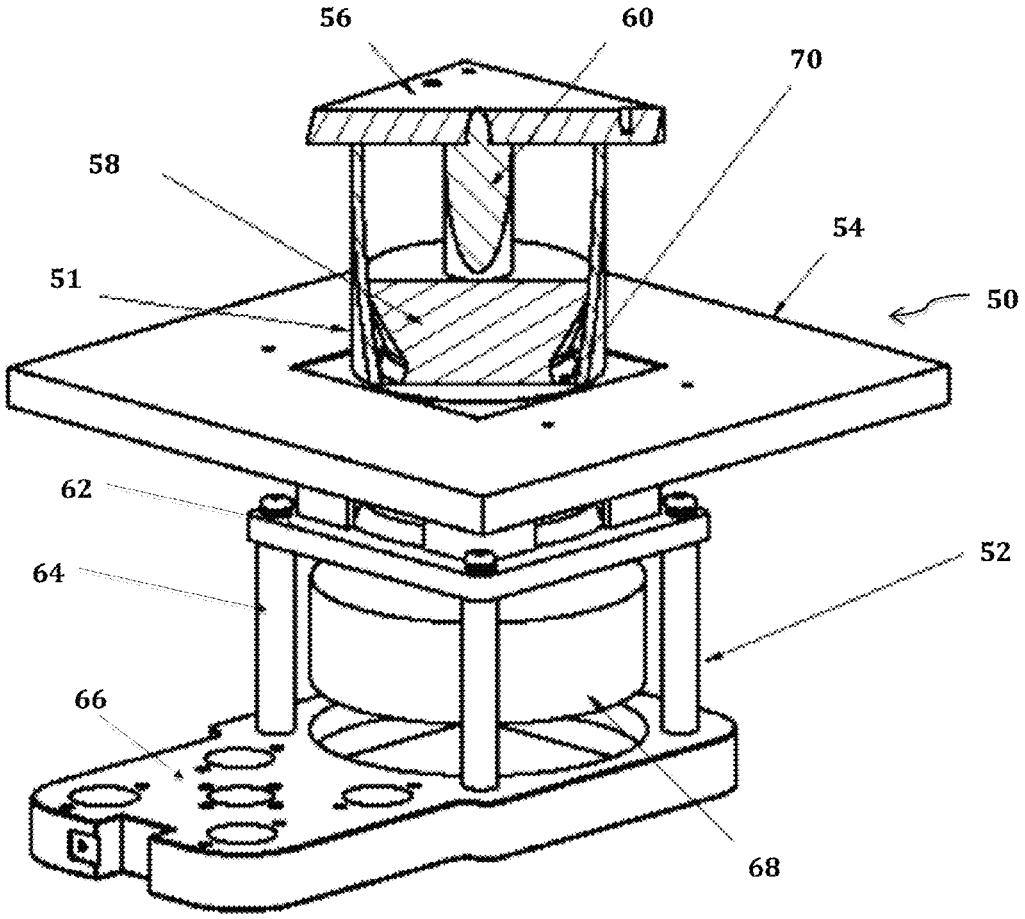
FIG. 7 shows a schematic diagram of an assembled apparatus according to the present invention.

FIG. 7 further shows an embodiment of the present invention demonstrating an assembled apparatus 50 having a supporting system 52 and the relevant fixtures and parts. In this embodiment, the sample tube 51 is supported on a stage 54 and is fixedly positioned between an upper fixing means 56 and the stage 54. A reflector 58 is arranged inside the tube sample 51, and a bar 60, which is connected to the upper fixing means 56, is placed on top of the reflector to prevent displacement of the reflector 58 during the treatment. The stage 54 is supported by a supporting frame 62, which includes four supporting legs 64 connecting with a base member 66. A vibration horn 68 is positioned below the stage 54 and within the supporting frame 62, and is adapted to produce and transmit vibrations to the sample tube 51. A plurality of balls 70 are provided in a cavity between the reflector 58 and an inner surface of the sample tube 51 to allow collisions on the inner surface of the sample tube 51. Again, a person skilled in the art will appreciate that the design of the assemble apparatus of the present invention should not be limited to the specific embodiment described, but will understand that variations to the design such as different forms of supporting arrangements will be applicable to the present invention.

The results as revealed in the above experiments shown that the present invention is beneficial in improving the strength of the inner surface of a tubular metallic structure of the material, and that the tubular structure can then carry more loads when compared with an untreated structure, especially when both the inner and outer surfaces of the tubular structure are surface-treated. In addition, the present invention introduced a SMAT apparatus and surface treatment method which is efficient, simple and cost effective. Furthermore, the apparatus and method of the present invention is versatile, which can be easily set up and conducted in lab scale environment, and also capable of scaling up to meet various industrial applications.

It should be understood that the above only illustrates and describes examples whereby the present invention may be carried out, and that modifications and/or alterations may be made thereto without departing from the spirit of the invention.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable subcombination.

The invention claimed is:

1. A method for processing a surface, comprising the steps of:

supporting a structure having an inner surface on a platform, disposing at least one ball adjacent to the inner surface, positioning a reflecting member adjacent to the inner surface, wherein at least part of the reflecting member is arranged within the structure, wherein the at least one ball is adapted to vibrate by a vibrating means and to collide with the inner surface and the reflecting member thereby creating an impact to the inner surface.

2. The method according to claim 1, wherein the vibrating means is positioned below the platform.

3. The method according to claim 1, wherein the vibrating means is positioned at least partially within the structure.

4. The method according to claim 1, wherein the structure is positioned such that a central axis thereof is substantially perpendicular to the platform.

5. The method according to claim 4, wherein the central axis of the structure is arranged in parallel to a longitudinal axis of the reflecting member.

6. The method according to claim 4, wherein the central axis of the structure is arranged in parallel to longitudinal axes of the reflecting member and the vibrating means.

7. The method according to claim 4, wherein the structure and the reflecting member are coaxially arranged.

8. The method according to claim 4, wherein the structure, the reflecting member and the vibrating means are coaxially arranged.

9. The method according to claim 1, wherein the structure is of tubular shape.

10. The method according to claim 9, wherein the reflecting member comprises a circular side wall circumferentially abuts the inner surface of the structure.

11. The method according to claim 10, wherein the reflecting member comprises at least one inclined wall extended downwardly and tapered inwardly from the circular side wall, the at least one inclined wall is adapted to collide with the ball.

12. The method according to claim 1, wherein at least part of the reflecting member is of a shape of a frustum.

13. The method according to claim 1, wherein the structure is made of metal or metal alloy.

14. An apparatus for processing a surface, comprising:

a platform arranged to support a structure having an inner surface, at least one ball disposed adjacent to the inner surface, and a reflecting member having at least one reflecting surface, wherein at least part of the reflecting member is arranged within the structure, and wherein the at least one ball is adapted to vibrate by a vibrating means and to collide with the inner surface and the reflecting surface thereby creating an impact to the inner surface.

15. The apparatus according to claim 14, wherein the vibrating means is positioned below the platform surface.

16. An apparatus for processing a surface, comprising:

a platform arranged to support a structure having an inner surface, at least one ball disposed adjacent to the inner surface, and a reflecting member having at least one reflecting surface, wherein the at least one ball is adapted to vibrate by a vibrating means and to collide with the inner surface and the reflecting surface thereby creating an impact to the inner surface, and wherein the vibrating means is positioned at least partially within the structure.

17. The apparatus according to claim 14, wherein the structure is positioned such that a central axis thereof is substantially perpendicular to the platform.

18. The apparatus according to claim 17, wherein the central axis of the structure is arranged in parallel to a longitudinal axis of the reflecting member.

19. The apparatus according to claim 17, wherein the central axis of the structure is arranged in parallel to longitudinal axes of the reflecting member and the vibrating means.

20. The apparatus according to claim 17, wherein the structure and the reflecting member are coaxially arranged.

21. The apparatus according to claim 17, wherein the structure, the reflecting member and the vibrating means are coaxially arranged.

22. The apparatus according to claim 14, wherein the structure is of tubular shape.

23. The apparatus according to claim 22, wherein the reflecting member comprises a circular side wall circumferentially abuts the inner surface of the structure.

24. The apparatus according to claim 23, wherein the reflecting member comprises at least one inclined wall extended downwardly and tapered inwardly from the circular side wall, the at least one inclined wall is adapted to collide with the at least one ball.

25. The apparatus according to claim 24, wherein the reflecting member comprises a base portion extended downwardly from the at least one inclined wall and is positioned adjacent to the platform.

26. The apparatus according to claim 14, wherein at least part of the reflecting member is of a shape of a frustum.

27. The apparatus according to claim 14, wherein the tubular structure is made of metal or metal alloy.

28. The apparatus according to claim 14, wherein the platform is supported by a supporting arrangement.

29. The apparatus according to claim 14, wherein the structure is fixedly positioned on the platform via a fixing means.

* * * * *